United States Patent [19]

McBride

[11] Patent Number: 4,850,383

[45] Date of Patent: Jul. 25, 1989

[54] CRUTCH BAG

[76] Inventor: Kay K. McBride, P.O. Box 331, Grants, N. Mex. 87020

[21] Appl. No.: 162,141

[22] Filed: Feb. 29, 1988

[51] Int. Cl.[4] ..... A61H 3/02

[52] U.S. Cl. ..... 135/66; 135/68

[58] Field of Search ..... 135/65, 66, 68

[56] References Cited

U.S. PATENT DOCUMENTS

| | | | |
|---|---|---|---|
| 2,210,493 | 8/1940 | Lisi | 135/66 |
| 2,311,049 | 2/1943 | Hedden | 135/68 |
| 2,423,635 | 7/1947 | Blum | 135/68 |
| 2,553,730 | 5/1951 | Taylor | 135/66 X |
| 2,912,991 | 11/1959 | Shinn | 135/66 X |
| 3,985,148 | 10/1976 | Cadman | 135/66 |
| 4,027,687 | 6/1977 | McGowan | 135/66 |
| 4,146,045 | 3/1979 | Grant | 135/66 |
| 4,289,156 | 9/1981 | Ulics | 135/66 |
| 4,295,483 | 10/1981 | Smith | 135/66 |

*Primary Examiner*—Henry E. Raduazo
*Assistant Examiner*—Lan Mai
*Attorney, Agent, or Firm*—Fleit, Jacobson, Cohn, Price, Holman & Stern

[57] ABSTRACT

An upwardly opening and downwardly tapering bag-type container is provided and receivable within the crotch area of a conventional Y-type crutch above the lower leg thereof and below the transverse handle of the crutch. Opposite side portions of the open upper end of the bag include tie straps for securement about opposite ends of the handle and the lower closed end of the bag includes tie straps for encircling the downwardly convergent lower portions of the side rails of the crutch immediately above the center depending leg thereof. The open upper end of the bag includes thistle-type fastener structure operatively associated therewith for releasably closing the open upper end of the bag.

5 Claims, 1 Drawing Sheet

CRUTCH BAG

BACKGROUND OF THE INVENTION

1. Field of the Invention

This invention relates to a receptacle for removable support from a Y-shaped crutch and wherein the receptacle is configured and supplied with releasable attaching means such that it may be supported in the crotch area of the Y-shaped crutch above the extendable leg thereof and below the handle of the crutch.

2. Description of Related Art

Various different forms of article receptacles heretofore have been provided for use in conjunction with canes and crutches. Examples of these previously known devices are disclosed in U.S. Pat. Nos. 2,210,493, 2,311,049, 2,553,730, 2,912,991, 3,985,148, 4,027,687, 4,146,045 and 4,295,483.

Of the above noted prior patents U.S. Pat. Nos. 2,311,049, 3,985,148, 4,146,045 and 4,295,483 disclose receptacles supported from Y-shaped crutches between the downwardly convergent lower ends of the side rails thereof below and above the corresponding crutch handle and lower leg portion, respectively. However, these receptacles are specifically designed and shaped for a Y-type crutch having certain dimensions in the crotch area thereof. Accordingly, a need exists for an article receiptacle which may be utilized in conjunction with substantially all Y-type crutches.

SUMMARY OF THE INVENTION

The crutch bag of the instant invention comprises a vertically elongated receptable constructed of durable flexible material (which may be waterproof) and which tapers in a downward direction and includes a closed bottom and an open top. By being constructed of flexible material, the receptacle will conform, at least generally, to the crotch area of substantially all Y-type crutches below the handle or handgrip thereof. The bottom of the receptacle or bag is provided with a pair of strap sections for removable securement about the lower extremities of the downward convergent side rails of an associated crutch immediately above the adjustable length leg thereof and opposite side portions of the upper end of the receptacle each are provided with a pair of tie straps for removable securement about the corresponding ends of the handgrip or handle of the corresponding crutch disposed immediately thereabove. By this construction, the receptacle may be readily removably supported from substantially all different makes of Y-type crutches.

The main object of this invention is to provide a convenient receptacle for carrying various articles and which may be readily and securely supported from Y-type crutches of substantially any manufacture.

Another object of this invention is to provide a receptacle in accordance with the preceding objects and which may be readily opened and closed.

Still another important object of this invention is to provide an items receptacle for support from a Y-type crutch and wherein the receptacle is constructed of water repellent material.

A further object of this invention is to provide an items receptacle which may be produced in only one size and shape and be usable in conjunction with Y-type crutches of different sizes and manufacture.

A final object of this invention to be specifically enumerated herein is to provide an items receptacle for support from a Y-type crutch and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
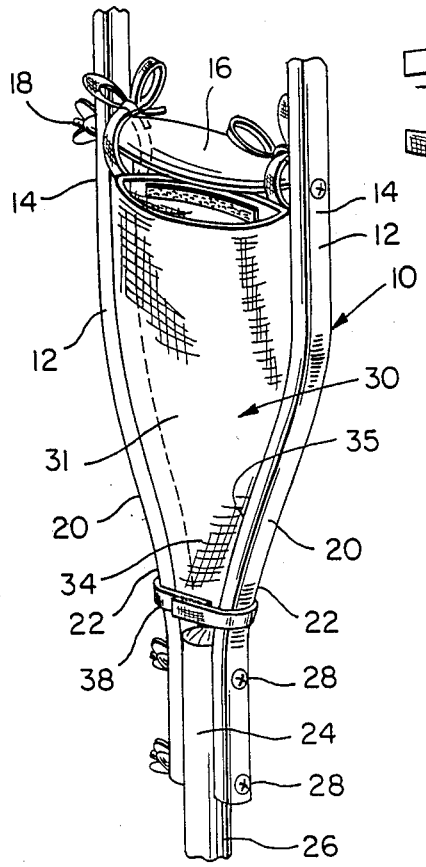
FIG. 1 is a fragmentary perspective view of a typical Y-type crutch with a crutch bag or receptacle constructed in accordance with the present invention operatively supported therefrom.
Figure 2:
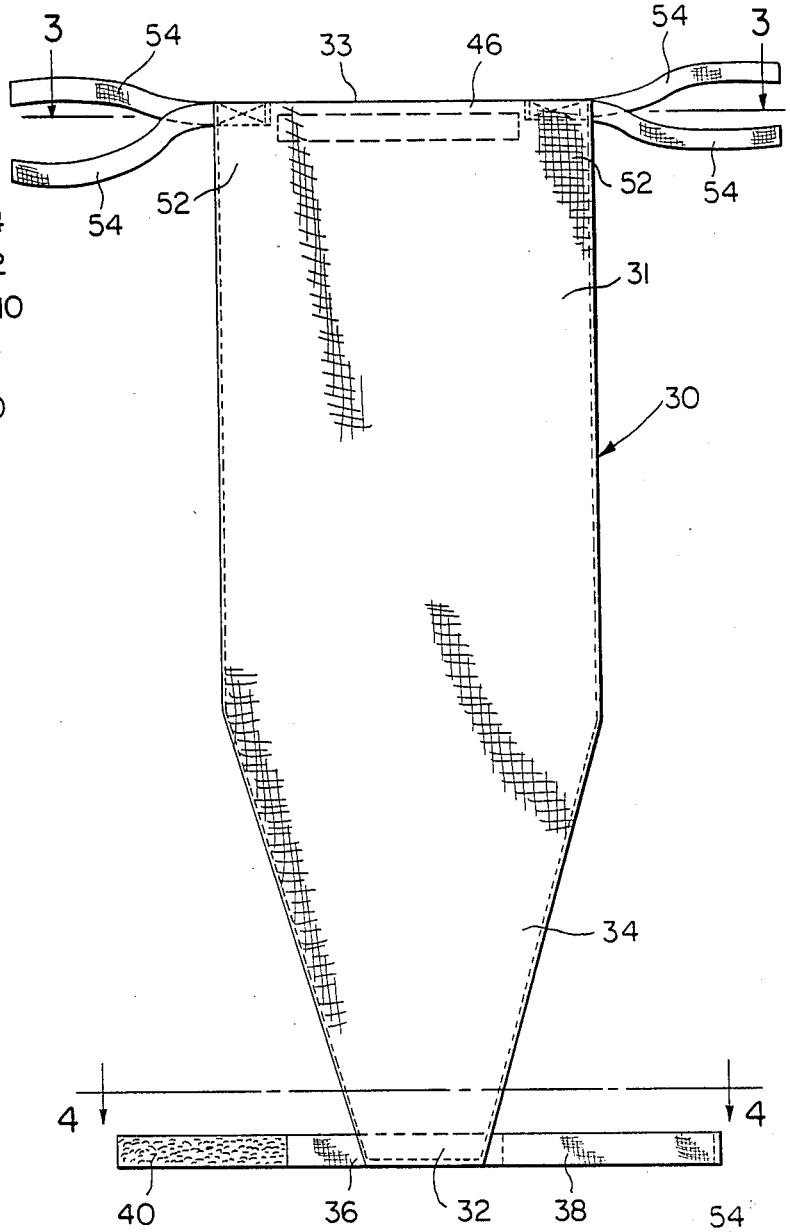
FIG. 2 is an enlarged side elevational view of the receptacle.
Figure 3:
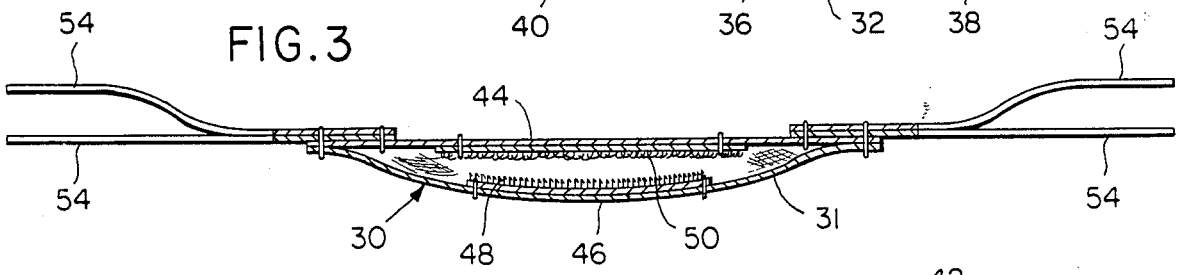
FIG. 3 is an enlarged horizontal sectional view taken substantially upon the plane indicated by the section line 3—3 of FIG. 2.
Figure 4:
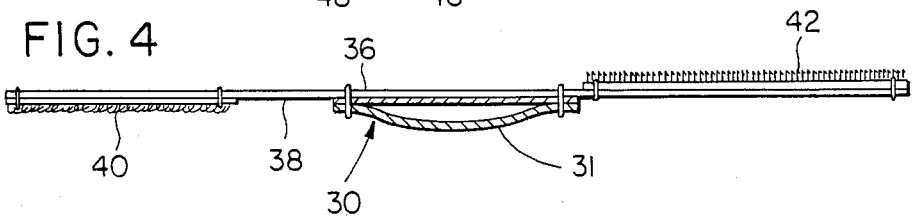
FIG. 4 is an enlarged horizontal sectional view taken substantially upon the plane indicated by the section line 4—4 of FIG. 2.

Referring now more specifically to the drawings, the numeral 10 generally designates a conventional form of Y-type crutch including opposite side rails 12 having mid-height portions 14 between which a horizontally elongated handle or handgrip 16 extends and is secured through the utilization of a fastener 18 extending and secured through the rails 12 and the center of the handle or handgrip 16. The rails 12 include convergent lower portions 20 terminating downwardly in terminal end portions 22 between which the upper end 24 of a vertically adjustable upstanding leg 26 is secured through the utilization of suitable through fasteners 28, the upper ends of the rails 12 being broken away, but conventionally interconnected by a horizontally elongated padded support (not shown) for engagement in the armpit of a user of the crutch 10.

The foregoing comprises a description of a typical form of Y-shaped crutch which may be purchased or rented inexpensively by persons requiring short-term usage of a crutch or crutches.

Persons who experience hip, leg, knee, foot and/or ankle injuries often find it necessary to utilize a crutch or crutches for a short period of time and these persons usually will purchase or rent inexpensive crutches such as that indicated by the reference numeral 10. Furthermore, a majority of persons who have used crutches have only experienced the need for the use of crutches once or twice for a short period of time. Therefore, the majority of persons who use crutches are not experienced in their usage and have a need for some means by which small articles may be carried while using crutches.

The crutch bag of the instant invention is referred to in general by the reference numeral 30 and has been specifically designed for use in conjunction with crutches of the type indicated by the reference numeral 10. The crutch bag 30 is of lightweight construction, is constructed of flexible fabric material thereby enabling the bag to be readily cleaned and the bag may be manufactured in various colors and of various materials. Still further, the usage of flexible material enables the bag 30 to conform to the shape of articles to be contained therein and to readily conform to inexpensive Y-type crutches such as that indicted at 10 and manufactured in different sizes and slightly different configurations by a plurality of crutch manufacturers. In addition, the crutch bag is constructed in a manner whereby it can be readily attached to and removed from relatively inexpensive Y-type crutches without any disassembly of the crutches and without modifications to or disfigurement of the crutches. These operating characteristics of the bag 30 enable a one-time user of rental crutches to purchase, or rent, the bag 30 and to apply the bag to and remove the bag from rental crutches with ease and without any possibility of damage or disfigurement of rented crutches.

The bag 30 comprises a vertically elongated receptacle 31 constructed of flexible material and including a closed bottom or lower end 32 and an open top or upper end 33. The receptacle 31 includes a tapered lower end portion 34 for seating within the crotch area 35 of the crutch 10.

The closed lower end 32 of the receptacle 31 has the longitudinal mid-portion 36 of a flexible material strap 38 secured thereto by stitching and opposite sides of the opposite end portions of the strap 38 include loop and hook thistle-type fastener strips 40 and 42 secured thereto. In addition, the opposing inner surfaces of the opposing upper marginal edge portions 44 and 46 of the receptacle 31 include similar loop and hook thistle-type fastener strips 48 and 50 secured thereto. Finally, each side portion 52 of the upper end of the receptacle 32 has a pair of tie straps 54 secured thereto by stitching.

In operation, the receptacle 31 is received in the crotch area 35 beneath the handle 16 and the opposite end portions of the strap 38 are wrapped about the terminal end portions 22 and engaged with each other in free end overlapped relation with the strips 40 and 42 releasably securing the free end portions of the strap 38 together. In addition, each pair of tie straps 54 is passed and tied about the corresponding end of the handle 16.

The receptacle 31 may thus be quickly mounted within the crotch area 35 of the crutch 10 in a manner which does not require any disassembly of or modification to the crutch 10. Further, the straps 38 and 54 do not disfigure or otherwise injure the crutch 10.

Articles to be carried within the receptacle 31 then may be inserted into the receptacle 31 through the open upper end thereof and the upper end of the receptacle 31 then may be releasably closed by engaging the strips 48 and 50 with each other. Further, it will be noted that the handle 16 actually comprises a partial closure for the upper end of the receptacle 31 when the strips 48 and 50 are not engaged with each other. Thus, if frequent access to an article carried within the receptable 31 is desired, the strips 48 and 50 need not be engaged with each other in order to close the upper end of the receptacle, inasmuch as the handle 16 will act to block accidental movement of larger articles from within the receptacle 31 during normal usage of the crutch 10.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a Y-type crutch including a pair of upstanding laterally spaced side rails interconnected at mid-height portions by a horizontally elongated handle extending and connected between said rails, said rails including downwardly convergent lower portions below said handle having lower terminal end portions between which the upper end of an upright leg is secured, an article container comprising a vertically elongated receptacle including a closed lower end and an open upper end, said receptacle being removably received between said rails closely below said handle and above said leg and being downwardly tapered to conform, at least generally, to the space defined between said downwardly convergent portions below said handle, the upper end of said receptacle including opposite side portions disposed closely below opposite end portions of said handle and the lower end of said receptacle at least closely opposing the upper end of said leg, each of said opposite side portions including first strap means removably and adjustably secured about the corresponding end portion of said handle supporting the weight of said receptacle and any articles therein from the opposite end portions of said handle and preventing downward displacement of said receptacle relative to said handle and said lower end of said receptacle including second strap means removably and adjustably encircling said lower terminal end portions and thereby laterally satabilizing the lower end of said receptacle relative to said lower terminal end portions and preventing upward displacement of said lower end of said receptacle relative to said lower terminal end portions.

2. The crutch and container combination of claim 1 wherein said receptacle comprises a bag constructed of flexible material.

3. The crutch and container combination of claim 1 wherein said second strap means comprises a pair of strap sections having free ends encircling said terminal end portions and equipped with overlap engaged thistle-type fastener strips.

4. The crutch and container combination of claim 2 wherein said open upper end of said bag includes opposing upper marginal edge portions extending between said rails, said upper marginal edge portions including coacting fastener means releasably engageable with each other to close the upper end of said bag.

5. The crutch and container combination of claim 4 wherein said coacting fastener means includes hook and loop thistle-type fastener strips carried by said upper marginal edge portions releasably engageable with each other.

* * * * *